United States Patent [19]

Ettell et al.

[11] 4,401,630

[45] Aug. 30, 1983

[54] PROCESS FOR COBALT RECOVERY FROM MIXED SULFIDES

[75] Inventors: Victor A. Ettell; Juraj Babjak, both of Mississauga, Canada

[73] Assignee: INCO Ltd., Toronto, Calif.X

[21] Appl. No.: 298,208

[22] Filed: Aug. 31, 1981

[30] Foreign Application Priority Data

Dec. 23, 1980 [CA] Canada ..... 367465

[51] Int. Cl.[3] ..... C01G 51/00; C01G 53/11; C01G 3/12; C22B 3/00

[52] U.S. Cl. ..... 423/34; 423/37; 423/144; 423/150

[58] Field of Search ..... 423/150, 37, 34, 36, 423/146; 75/101 R, 109, 103

[56] References Cited

U.S. PATENT DOCUMENTS

| | | | |
|---|---|---|---|
| 2,588,265 | 3/1952 | McGauley | 423/37 |
| 3,616,331 | 10/1971 | O'Neill et al. | 423/150 |
| 3,652,265 | 3/1972 | Marschik et al. | 423/36 |
| 3,751,558 | 1/1972 | Crnojevich et al. | 423/144 |
| 4,304,644 | 2/1981 | Victorovich et al. | 423/36 |
| 4,312,841 | 1/1982 | Tolley et al. | 423/150 |
| 4,323,541 | 5/1982 | Saarinen et al. | 423/150 |

OTHER PUBLICATIONS

Plasket, R. P., Recovery of Nickel and Copper from High Grade Matte at Impala Platinum by The Sherritt Process, AIME-TMS A74-102.

"Llanos, Z. R. Atmospheric Leaching of Matte at Port Nickel Refinery" Hydrometallurgy, Oct. 1973, p. 74.

*Primary Examiner*—O. R. Vertiz

*Assistant Examiner*—Robert L. Stoll

*Attorney, Agent, or Firm*—Ewan C. MacQueen; Edward A. Steen; Raymond J. Kenny

[57] ABSTRACT

The metal content of nickel-cobalt mixed sulfide slurries is recovered by atmospheric oxidation leaching, thereafter removing dissolved copper by metathesis with further mixed sulfide feed, treating the filtrate after liquid-solids separation with ammonia to selectively precipitate cobalt, separating the cobalt precipitate and working up the resulting filtrate to recover nickel.

7 Claims, No Drawings

PROCESS FOR COBALT RECOVERY FROM MIXED SULFIDES

PRIOR ART AND BACKGROUND OF THE INVENTION

In the hydrometallurgical treatment of ores containing nickel cobalt and/or copper, by-product sulfides containing the metals cobalt, nickel and/or copper may be generated in various points in the process. As an example, the purification of nickel bearing ammoniacal leach liquors to remove cobalt and copper can produce precipitates which are usually in the form of a thickener underflow or a filter cake and which contain up to 75% moisture. These materials are finely divided and may include, besides the valuable metals cobalt, nickel and copper various other impurities and residual ammonia. These materials are difficult to treat and at present the only known ways of treating them for the purpose of recovering metal values involve leaching at elevated temperature and pressure. Such a process is described in a paper presented at 109 AIME Annual Meeting, Las Vegas, Nev., U.S.A. in February, 1980 by Suetsuna et al. Treatment of materials at elevated temperature and pressure in autoclaves is expensive and it would be desirable to provide a means for treating nickel, cobalt, copper sulfide residues at atmospheric pressure. In this connection the atmospheric leaching of mattes is known and is described for example in a paper entitled, "Atmospheric Leaching of Matte at the Port Nickel Refinery" by Llanos et al., which appeared in the CIM Bulletin, February, 1974, pages 74–81. The known atmospheric leaching processes seem to involve the treatment of matte with an acid solution having a high copper content such as spent copper electrowinning electrolyte depleted with respect to copper and having a considerable content of acid. When such such solutions are reacted with matte, a cementation reaction occurs with precipitation of the copper content of the solution and solubilization of nickel and cobalt values in the matte. The economic utilization of such a process depends, of course, on the ready availability of acid solutions containing copper. It is also known from the work of Dr. -Ing Hans Grothe dating back to the 1930's (German Pat. No. 595,688) that ammonia may be used in the treatment of a water solution of cobalt and nickel sulfates to precipitate cobalt and provide a cobalt precipitate depleted in nickel and a solution enriched in nickel and depleted in cobalt. U.S. Pat. No. 3,751,558 is also relevant.

Materials to the treatment of which the invention is particularly directed will usually contain, on a dry basis, about 0.5% to about 15% cobalt, about 5% to about 30% nickel up to about 25% copper, up to about 15% iron and about 15% to about 30% sulfur. The materials usually occur as a result of sulfide precipitation from solution to recover the metal content thereof. The materials may also contain up to about 8% ammonia from prior processing.

STATEMENT OF THE INVENTION

The invention is directed to the recovery of metal values from mixed nickel-cobalt sulfides, usually synthesized in the recovery processes of one or more of the metals involved, by atmospheric pressure leaching using air as an oxidant. The process comprises slurrying the sulfide feed material in water or a mixture of recycled pregnant leach liquor and water to provide a slurry containing about 5% to about 30% solids, (preferably 15% to 25% solids) by weight. Desirably the ammonia content, if any, of the feed material should be controlled to a value not exceeding about 10 grams per liter ammonia. Otherwise crystallization of a mixed ammonium sulfate, metal sulfate salt may occur undesirably. The ammonia content of the initial material can be removed and recovered by known methods.

The leach slurry is subjected to oxidative leaching at atmospheric pressure using air as an oxidant and with good agitation. The leaching process occurs at a pH which is essentially neutral to only slightly acidic. Thus, depending upon the presence of ammonia in the starting material, the initial pH of the feed slurry may be in a range of about pH 5 to about pH 8. The reaction temperature and rate of air addition may be varied rather widely. For example, the temperature employed may lie in a range of about 40° C. to about 100° C. while the rate of air addition should be between 0.05 liters per liter of slurry per minute and several, e.g., 5, liters per liter of slurry per minute. Economically, a reaction temperature of about 70° C. to about 80° C. and a rate of air addition of about 0.3 to about 0.5 liters per liter of slurry per minute is satisfactory. It is found that the heat generated by the oxidation of sulfides to sulfate is approximately that equal to the heat removed from the system by the exiting air stream saturated with water vapor at the reaction temperature. Agitation is employed so as to effect good contact between the solids being leached and the active oxidative reagent namely oxygen. In general, leaching is completed in about 8 hours to about 40 hours.

Many mixed sulfide materials to be treated may contain copper sulfide which is undesirable in a final cobalt or nickel product. The amount of copper dissolved can be limited by monitoring the pH of the leach slurry. To the extent that dissolution of copper occurs during oxidative leaching, it is found that the concentration of copper can be reduced and the additional benefit of dissolving still further quantities of nickel and cobalt can be affected by a metathetic leaching between the leached copper and nickel and cobalt sulfides. The metathetic leach preferably is carried out in a temperature range of about 70° to 80° C. and is conducted in the absence of aeration. Desirably, the pH of leach slurry is adjusted to approximately pH 5 during the metathetic leach so as to increase the extraction of cobalt and nickel from the fresh sulfide material and to reduce the concentration of copper. Upon the completion of the leach, the slurry is subjected to solid-liquid separation to recover the leach liquor containing dissolved cobalt and nickel values. The residue can either be rejected or treated further depending on the metal value content thereof.

The leach liquor is then treated for cobalt recovery and desirably to effect as much as possible the separation of cobalt and nickel. A preferred method to accomplish this result is to treat the leach liquor with ammonia at a pH of approximately 8.3 to effect selective precipitation of cobalt. Either anhydrous or aqueous ammonia can be used. The reaction can be carried out for example in an agitated tank at an operating temperature of about 60° C., although a temperature in the range of about 40° C. to about 80° C. may be employed. The resulting cobalt precipitate is separated by thickening and/or filtration and the filtrate is then treated for nickel recovery.

EXAMPLE I (batch leaching)

A mixed sulfide filter cake analyzing by weight 1.62% cobalt, 17% nickel, 26.5% copper, 1.15% selenium, 4.1% iron, 19% sulfur was pulped in water to provide two liters of slurry containing 20% solids by weight. The feed slurry was charged to a 2.5 liter baffled vessel equipped with a 2-inch diameter radial turbine turning at 1000 rpm. The vessel was supplied with air at atmospheric pressure at a rate of 0.32 liters per liter of slurry per minute. The solution was assayed for metal values and pH at various times over a leaching period of 21.5 hours with the results shown in the following Table I.

TABLE I

| Leaching | Solution Assay, g/l | | | | | pH at |
|---|---|---|---|---|---|---|
| Time, h | Co | Ni | Cu | Se | Fe | 22° C. |
| 2 | 0.031 | 0.92 | 0.005 | 0.004 | — | 8.1 |
| 4 | 0.340 | 3.52 | 0.001 | 0.005 | — | 7.2 |
| 5.5 | 0.75 | 6.46 | 0.005 | 0.008 | — | 6.95 |
| 7.5 | 1.37 | 11.0 | 0.002 | 0.017 | — | 6.65 |
| 9.5 | 1.97 | 15.9 | 0.012 | 0.028 | — | 6.42 |
| 11.0 | 2.21 | 18.2 | 0.060 | 0.026 | — | 6.25 |
| 15.5 | 2.90 | 23.2 | 0.320 | 0.045 | — | 5.62 |
| 18.0 | 3.25 | 26.6 | 0.810 | 0.033 | — | 5.45 |
| 21.5 | 3.45 | 29.6 | 1.29 | 0.026 | <0.001 | 5.25 |

The results given in Table I demonstrate an extraction of 89.6% cobalt, 73.2% nickel, 2% copper and 0.9% selenium.

50 grams of the initial feed cake were then added to the leach slurry and the leaching carried out without aeration for four hours with the results in the following Table II.

TABLE II

| Time, h | Co | Ni | Cu | Se | Fe | pH |
|---|---|---|---|---|---|---|
| 2 | 3.75 | 30.1 | 0.290 | 0.003 | <0.001 | 5.65 |
| 4 | 3.75 | 30.1 | 0.019 | 0.002 | 0.001 | 5.50 |

The overall extraction including that derived from metathetic leaching represented 93.7% cobalt, 71.7% nickel, 0.03% copper and 0.07% selenium.

EXAMPLE II

A series of four batch runs was made at atmospheric pressure using a mixed sulfide precipitate pulped in water. In each case the feed employed originated from the ammoniacal leaching of a lateritic ore and contained on a dry basis 34.6% nickel, 8.76% cobalt, 0.93% copper, 1% iron and 27.4% total sulfur. The precipitate was dried and then repulped in water to 10% solids. The same reactor was employed as in Example I with an air rate of 0.5 liters per liter of slurry per minute. The results obtained in the four tests are set forth in the following Tables III through VI and the rates of extraction for the five tests of Examples I and II are given in Table VII.

TABLE III

| Test | Time | Solution, g/l | | | | | Ni+ Co | Temp. |
|---|---|---|---|---|---|---|---|---|
| No. | h | Ni | Co | Cu | Fe | pH | mol/l | °C. |
| 2 | 0 | 2.80 | 0.34 | <.001 | <.001 | 7.2 | .053 | 22 |
| | 0 | 3.50 | 0.28 | <.001 | <.001 | 7.2 | .064 | 80 |
| | 1 | 5.00 | 0.38 | <.001 | <.001 | 6.6 | .091 | |
| | 2 | 7.20 | 0.66 | <.001 | <.001 | 6.5 | 0.13 | |
| | 4 | 12.0 | 1.40 | <.001 | <.001 | 6.2 | 0.23 | |
| | 5 | 14.8 | 2.00 | <.001 | <.001 | 6.1 | 0.28 | |

TABLE III-continued

| Test | Time | Solution, g/l | | | | | Ni+ Co | Temp. |
|---|---|---|---|---|---|---|---|---|
| No. | h | Ni | Co | Cu | Fe | pH | mol/l | °C. |
| | 6 | 17.0 | 2.40 | <.001 | <.001 | 6.0 | 0.33 | |
| | 7 | 18.8 | 3.00 | <.001 | <.001 | 5.8 | 0.37 | |
| | 11.6 | 19.7 | 6.12 | <.001 | 0.23 | 4.0 | 0.610 | |
| | 23 | 37.4 | 9.12 | 0.92 | 0.62 | 2.8 | 0.792 | |
| | 24 | 37.4 | 9.27 | 1.16 | 0.64 | 2.7 | 0.794 | |

TABLE IV

| Test | Time | Solution, g/l | | | | | Ni+ Co | Temp. |
|---|---|---|---|---|---|---|---|---|
| No. | h | Ni | Co | Cu | Fe | pH | mol/l | °C. |
| 3 | 0 | 4.20 | 0.41 | <.001 | <.001 | 7.3 | .078 | 70 |
| | 2 | 7.92 | 0.83 | <.001 | <.001 | 7.15 | 0.15 | |
| | 4 | 12.8 | 1.70 | <.001 | <.001 | 6.9 | 0.24 | |
| | 6 | 17.6 | 2.95 | <.001 | <.001 | 6.6 | 0.35 | |
| | 9 | 26.0 | 5.61 | <.001 | .002 | 5.3 | 0.538 | |
| | 24 | 37.5 | 9.26 | 1.06 | 0.65 | 1.9 | 0.79 | |

TABLE V

| Test | Time | Solution, g/l | | | | | Ni+ Co | Temp. |
|---|---|---|---|---|---|---|---|---|
| No. | h | Ni | Co | Cu | Fe | pH | mol/l | °C. |
| 4 | 0 | 4.19 | 0.43 | <.001 | <.001 | 6.9 | .978 | 60 |
| | 2 | 7.08 | 0.68 | <.001 | <.001 | 6.8 | 0.13 | |
| | 4 | 10.2 | 1.20 | <.001 | <.001 | 6.7 | 0.19 | |
| | 6 | 15.0 | 2.18 | <.001 | <.001 | 6.65 | 0.29 | |
| | 9 | 24.6 | 4.12 | <.001 | <.001 | 5.4 | 0.49 | |
| | 24 | 37.5 | 8.97 | 1.10 | 0.69 | 2.6 | 0.79 | |

TABLE VI

| Test | Time | Solution, g/l | | | | | Ni+ Co | Temp. |
|---|---|---|---|---|---|---|---|---|
| No. | h | Ni | Co | Cu | Fe | pH | mol/l | °C. |
| 5 | 0 | 3.18 | 0.29 | .001 | .001 | 7.2 | .059 | 50 |
| | 2 | 5.64 | 0.47 | .001 | .001 | 7.0 | 0.10 | |
| | 4 | 7.97 | 0.76 | .001 | .001 | 6.95 | 0.15 | |
| | 6 | 9.82 | 1.02 | .001 | .001 | 6.9 | 0.18 | |
| | 7.5 | 11.9 | 1.43 | .001 | .001 | 6.8 | 0.22 | |
| | 24 | 27.2 | 6.30 | .018 | .001 | 5.8 | 0.57 | |
| | 27 | 30.3 | 7.24 | .053 | .001 | 5.6 | 0.64 | |
| | 30 | 36.3 | 9.00 | .156 | .001 | 5.5 | 0.77 | |

TABLE VII

| Test No. | Temperature (°C.) | Air Rate /(slurry/min) | Rate of Leaching (mol $Me^{++}$/.h)* |
|---|---|---|---|
| 1 | 80 | 0.32 | 0.0286 |
| 2 | 80 | 0.50 | 0.044 |
| 3 | 70 | 0.50 | 0.044 |
| 4 | 60 | 0.50 | 0.0270 |
| 5 | 50 | 0.50 | 0.0215 |

*mol $Me^{++}$ = Co + Ni + Cu

EXAMPLE III

Two 28 liter baffled vessels equipped with a six-inch diameter radial turbine rotating at 333 rpm were set up in series such that slurry from the first reactor for oxidative leaching was fed to the second reactor for metathetic leaching with a residence time of slurry in each reactor of 24 hours. A temperature of 70° C. was employed in each reactor with reactions in each being conducted at atmospheric pressure. The air rate in the first reactor was maintained in the range of 0.2 to 0.26 liters per liter of slurry per minute. The second reactor for metathetic leaching was not aerated. The pH in the metathetic leach reactor was maintained at about 4.9 by sulfuric acid addition. The system was operated over a period of time of 300 hours during which period 432 kilograms of material were treated. The sulfide precipitate treated analyzed, in weight percent 1.03% cobalt, 11.1% nickel, 16.8% copper, 7.1% iron, 0.008% zinc, 1.53% magnesium and 14.3% sulfur which was pulped in water to 15% solids. The overall results are shown in the following Table VIII.

TABLE VIII

| | Co | Ni | Cu |
|---|---|---|---|
| 1st Reactor (Oxidative Leaching | | | |
| Leaching liquor (g/l) | 1.04 | 5.9 | 0.046 |
| Extraction (%) | 55.0 | 32.0 | 0 |
| 2nd Reactor (pH Adj/Metathetic Leaching) | | | |
| Leach liquor (g/l) | 1.5 | 10.9 | 0.8 |
| Extraction (%) | 85.0 | 59.0 | 3.0 |

Although the feed material was of a relatively low grade, a satisfactory extraction of Co of 85% was achieved.

EXAMPLE IV (continuous cobalt precipitation)

A liquor analyzing in grams per liter 3.83 cobalt and 16.1 nickel at pH of 5 was fed continually to a 0.5 liter baffled vessel equipped with a 1.25-inch diameter radial turbine turning at 500 rpm, at a rate to provide an average residence time of liquor in the vessel of 5 minutes. The precipitant comprising a 200 gram per liter aqueous ammonia solution was added to the liquor on demand to maintain a pH of 9 at a temperature of 60° C. The precipitate was filtered and both the filtrate and precipitate analyzed for cobalt and nickel with the results shown in the following Table IX.

TABLE IX

| | Co | Ni |
|---|---|---|
| Filtrate (g/l) | 0.152 | 10.8 |
| Precipitate (%) | 25.4 | 20.6 |
| % Precipitated | 95.1 | 18.2 |

EXAMPLE V

The run shown in Example IV was repeated using a liquor analyzing in grams per liter 3.92 cobalt and 16.8 nickel at pH 5. In the test of this Example, anhydrous ammonia was used instead of aqueous ammonia and the results are shown in the following Table X.

TABLE X

| | Co | Ni |
|---|---|---|
| Filtrate (g/l) | 0.985 | 15.6 |
| Precipitate (%) | 39.6 | 13.9 |
| % Precipitated | 73.3 | 5.7 |

EXAMPLE VI

A leach liquor from a continuous leaching run analyzing 2.68 grams per liter cobalt, 11.8 grams per liter nickel, 0.44 grams per liter copper, 0.033 grams per liter selenium, 0.0011 grams per liter zinc, 0.081 grams per liter magnesium, 3.52 grams per liter ammonia and having a pH of 5.8 was fed to the reactor employed in Example IV. A residence time in the reactor of 1 minute was employed and anhydrous ammonia was used as a precipitant. The temperature was maintained at about 60° C. and the pH in the range of 8.2 to 8.3. One hundred eighty liters of the leach liquor were processed as described. The precipitate was settled and the underflow filtered and both the filtrate and the precipitate analyzed with the results shown in the following Table XI.

TABLE XI

| | Co | Ni | Cu | Se | $NH_3$ |
|---|---|---|---|---|---|
| Filtrate (g/l) | 0.49 | 9.85 | 0.41 | 0.015 | 15.3 |
| Precipitate (%) | 29.2 | 18.0 | 0.44 | 0.21 | — |
| % Precipitated | 81.7 | 16.5 | 6.8 | 54.5 | |

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A process resulting in the preferential recovery of cobalt occurring from the separation of cobalt, nickel, and copper values contained in a precipitated cobalt, nickel and copper sulfide feed material, the process comprising:

(a) slurrying the sulfide material in an aqueous medium essentially free of sulfuric acid to provide a slurry containing about 5% to about 30% solids by weight, the slurry not exceeding 10 grams of ammonia per liter, the pH of the slurry ranging from about 5 to 8 pH units, (b) oxidatively leaching the slurry at atmospheric pressure by aerating the slurry with an oxygen-containing gas, such as air, (c) agitating the slurry for a predetermined time to dissolve substantial portions of cobalt and nickel in the slurry, (d) upon completion of step (c) above, limiting the concentration of dissolved copper in the slurry by metatheticaly leaching the slurry in the absence of gas aeration and by adjusting the pH of the slurry to about 5 pH units to increase the concentration of cobalt and nickel while simultaneously reducing the concentration of copper, (e) recovering a leach liquor from the slurry containing the dissolved cobalt and nickel values, and (f) selectively recovering the cobalt from the leach liquor.

2. A process in accordance with claim 1 wherein the initial sulfide material contains, on a dry basis, about 0.5% to about 15% cobalt, about 5% to about 30% nickel, up to about 25% copper and about 15% to about 30% sulfur.

3. A process in accordance with claim 1 wherein the rate of gas addition is at least 0.05 liters per liter of slurry per minute.

4. A process in accordance with claim 3 wherein the rate of gas addition is about 0.3 to about 0.5 liters per liter of slurry per minute.

5. A process in accordance with claim 1 wherein the reaction temperature is between about 40° and about 100° C.

6. A process in accordance with claim 5 wherein the reaction temperature is about 70° C.

7. A process in accordance with claim 1 wherein the metathetic leach (step d) is conducted at a temperature of about 70° C. to about 80° C.

* * * * *